United States Patent [19]

Platt, Jr.

[11] 4,189,900

[45] Feb. 26, 1980

[54] APPARATUS AND METHOD TO TWIST TIE ARTICLES

[76] Inventor: Leland H. Platt, Jr., 5637 "C" Lake Murray Blvd., La Mesa, Calif. 92041

[21] Appl. No.: 914,057

[22] Filed: Jun. 9, 1978

[51] Int. Cl.[2] ..... B65B 57/08

[52] U.S. Cl. ..... 53/583; 140/93 A

[58] Field of Search ..... 53/399, 417, 583, 138 A; 140/93 A, 93.6

[56] References Cited

U.S. PATENT DOCUMENTS

| | | | |
|---|---|---|---|
| 2,970,416 | 2/1961 | Krueger et al. | 53/583 |
| 3,131,520 | 5/1964 | Wilson et al. | 53/583 X |
| 3,398,502 | 8/1968 | Halstead | 53/583 X |
| 3,490,128 | 1/1970 | Cammilli et al. | 53/583 X |
| 3,668,878 | 6/1972 | Holmes | 53/138 A |
| 3,729,896 | 5/1973 | Lehman | 53/583 |
| 3,983,681 | 10/1976 | Britt et al. | 53/138 A |
| 4,043,363 | 8/1977 | Tange | 53/583 X |
| 4,062,383 | 12/1977 | Saito | 53/583 X |
| 4,087,951 | 5/1978 | Tsuda et al. | 53/583 |

FOREIGN PATENT DOCUMENTS

| | | | |
|---|---|---|---|
| 847263 | 9/1960 | United Kingdom | 53/583 |

*Primary Examiner*—John Sipos

*Attorney, Agent, or Firm*—William W. Haefliger

[57] ABSTRACT

A tie band is secured about the neck of an article in response to displacement of the neck against that band and simultaneous travel of the neck and band.

15 Claims, 14 Drawing Figures

APPARATUS AND METHOD TO TWIST TIE ARTICLES

BACKGROUND OF THE INVENTION

This invention relates generally to production of ties around articles; more particularly it concerns method and apparatus to very simply, quickly and efficiently produce a reinforced band tie about the wall of an article, and more specifically a gathered wall such as a bag neck.

While considerable prior effort has been expended in the past to provide devices and methods to more rapidly tie bands around articles, as for example bread bags, and the like, none of such devices and methods of which I am aware incorporates the unusual combinations of structure, function and results as are now afforded by the present invention. These include very simple apparatus and method which enable the production of a band tie merely in response to displacement of a bag or article gathered neck into position against a band section, and simultaneous displacement of the neck and the section in such manner as to produce the tie. Such displacement may be carried out manually, as will be seen, whereby no motor is required.

SUMMARY OF THE INVENTION

Basically, the method of the invention involves carrying out the following steps:

(a) extending the band in a lengthwise feed direction,
(b) displacing the wall into position across a section of the extended band,
(c) effecting folding of said section of the band partially around said wall to provide two section arms relatively folded toward one another,
(d) relatively traveling said wall and folded arms in a travel direction, and
(e) twisting said arms during said relative travel to produce a tie about said wall.

As will be seen, twisting may be effected in response to wall travel so that the extent of twisting of the tie is a function of such travel; a band severing step may be effected in response to initial displacement of the article wall or neck toward the band section, and feeding of the band may be carried out in conjunction with neck and back simultaneous travel; and the band itself may consist of reinforced strips of paper or other flexible material.

The basic apparatus comprises:

(a) means for extending the band in a lengthwise feed direction,
(b) guide means for guiding the wall into position across a section of the extended band,
(c) means for effecting folding of said section of the band partially around the wall to provide two section arms relatively folded toward one another,
(d) means to effect relative travel of the wall and folded arms in a travel direction, and
(e) means for twisting said folded arms during said relative travel to produce a tie about said wall.

As will be seen, the travel effecting means may include a carriage to receive the bag neck, and to be pulled by the bag, the twisting means typically operates in response to carriage displacement along a rail or support; means is provided to sever a band section from a band main extent in response to reception of the bag neck in a carriage slot; and band feeding means may be provided to function in response to carriage travel.

These and other objects and advantages of the invention, as well as the details of an illustrative embodiment, will be more fully understood from the following description and drawings, in which:

DRAWING DESCRIPTION

Figure 1:
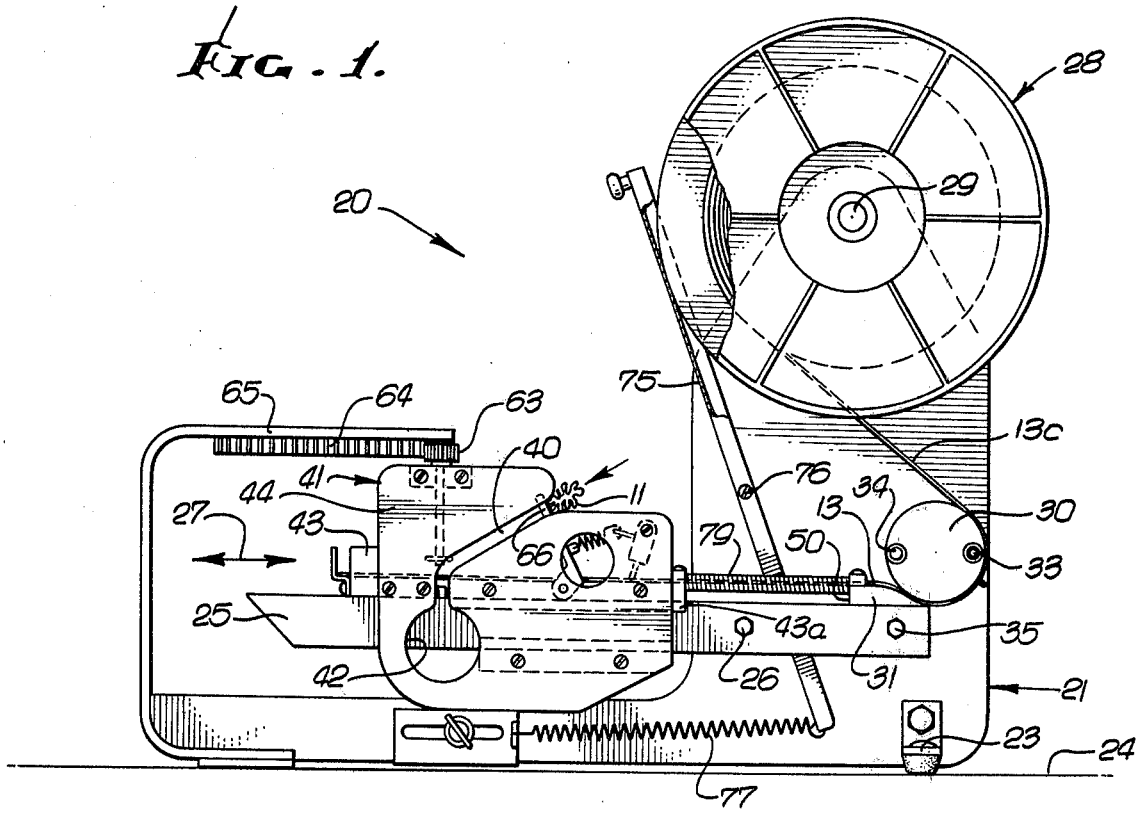
FIG. 1 is a side elevation showing details of apparatus incorporating the invention.
Figure 3:
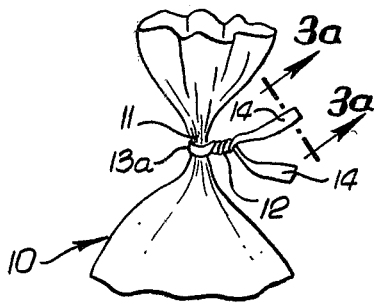
FIG. 3 is an elevation showing a typical tie around a bag neck.
Figure 3A:
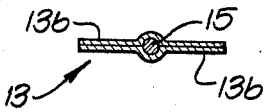
Figure 4:
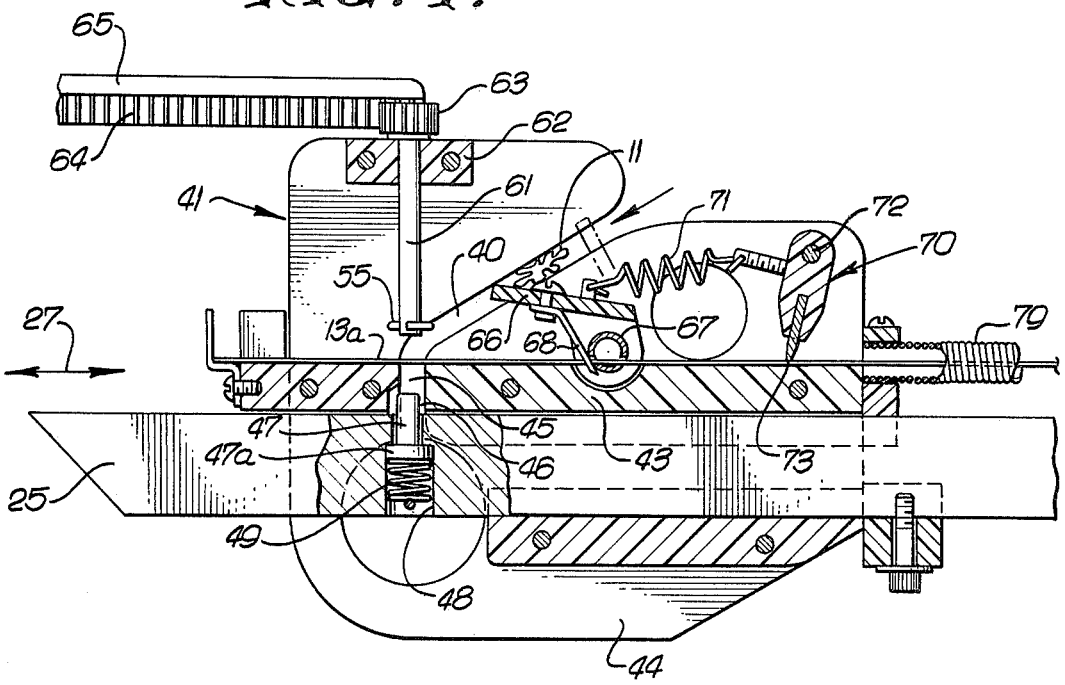
Figure 5:
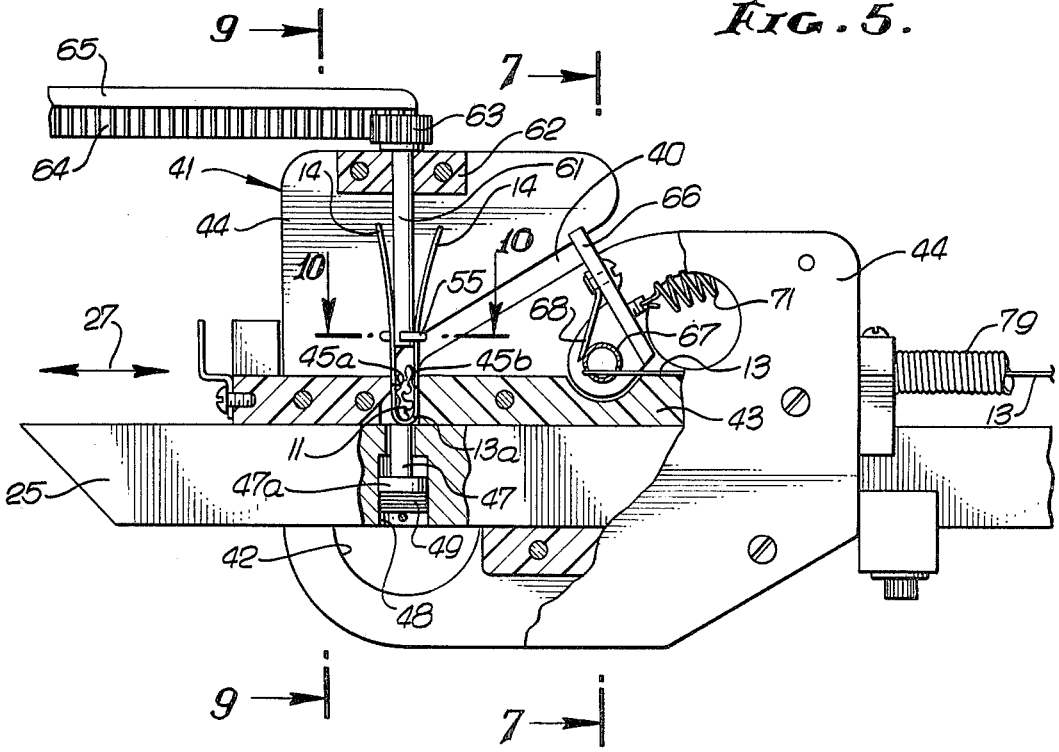
Figure 6:
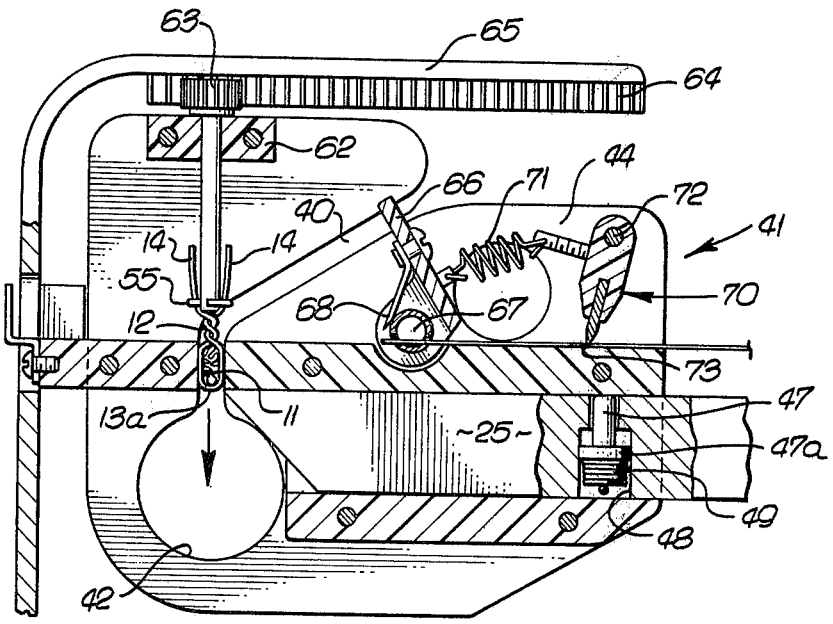
Figure 7:
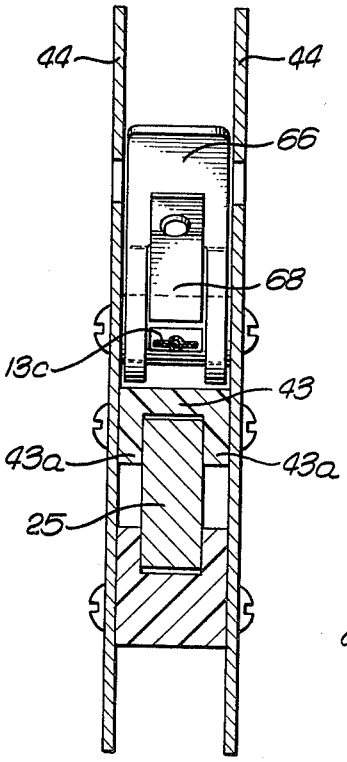
Figure 8:
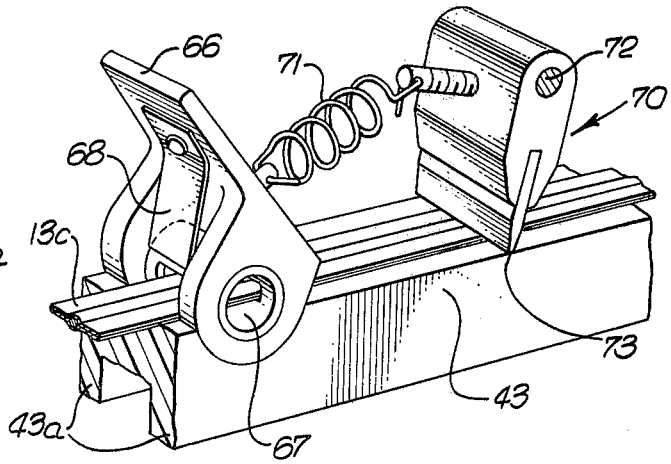
Figure 9:
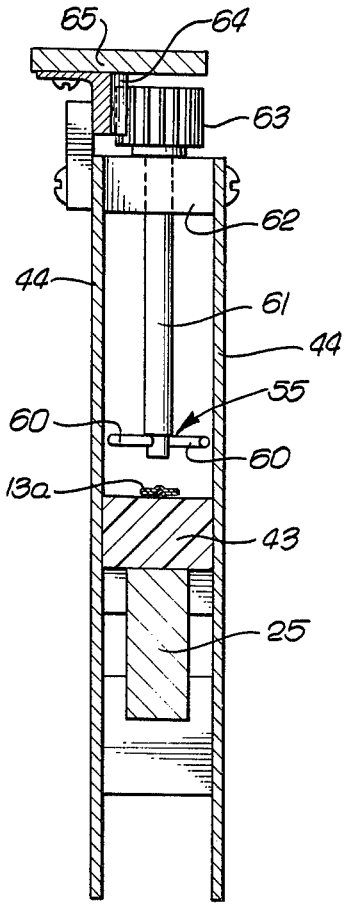
Figure 10:
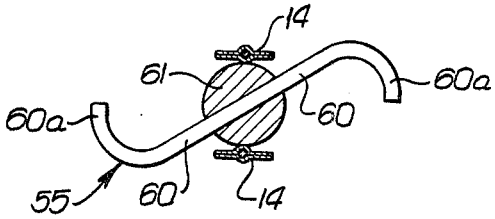
Figure 11:
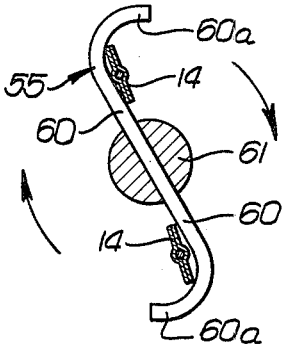
Figure 12:
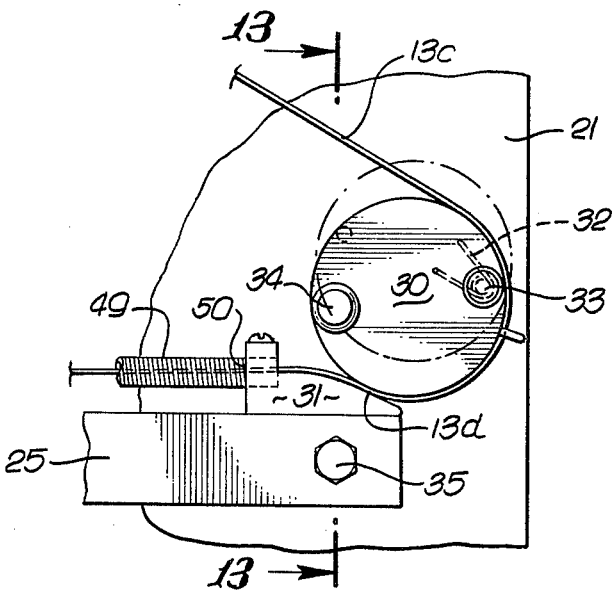
Figure 13:
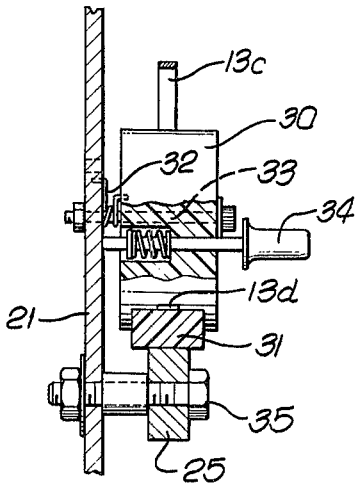

FIG. 3*a* is an enlarged section on lines 3*a*—3*a* of FIG. 3;

FIG. 4 is an enlarged fragmentary elevation showing guiding of the back neck into the apparatus of FIG. 1, and cutting of a band section;

FIG. 5 is a view like FIG. 4, showing a subsequent position of the bag neck in the apparatus, the cut band section being folded;

FIG. 6 is a view like FIGS. 4 and 5, but showing twisting or rotation of the folded band section to produce a tie;

FIG. 7 is an enlarged vertical section on lines 7—7 of FIG. 5;

FIG. 8 is a perspective showing relationship of a band cutter to a band clutch;

FIG. 9 is an enlarged vertical section on lines 9—9 of FIG. 5;

FIG. 10 is an enlarged plan view of a twisting grip to twist arms of the band section;

FIG. 11 is a view like FIG. 10 showing operation of the grip;

FIG. 12 is a fragmentary side elevation showing details of band feeding mechanism, also seen in FIG. 1; and FIG. 13 is a vertical section taken on lines 13—13 of FIG. 12.

DETAILED DESCRIPTION

Referring first to FIG. 3, a bag 10 is shown as having a gathered neck region 11 about which a tie 12 has been secured. The tie is formed by a section 13*a* of a band 13 (better seen in FIGS. 4 and 5), the band section having been folded into U-shaped to provide arms 14 which are then twisted about one another. The band may consist of a strip of paper, plastic or other flexible material which is reinforced, as for example by a central metallic wire or wires. Such a wire is shown at 15 in FIG. 3*a* embedded between attached layers 13*b* of a band strip 13. The neck 11 may more generally be included within a category of "walls" of articles to be circumscribed by ties, such articles not necessarily comprising bags.

Referring now to FIGS. 1, 2, and 4–13, the tie securing apparatus 20 illustrated includes a base or upright frame 21 which may have lateral legs 22 and 23 to engage a supporting surface 24. The base extends lengthwise in the direction of arrow 27, as does a rail or support 25 attached to the base as at 26.

A feed roller 28 is pivotally supported at 29 by the base, and carries wrappings of the main band 13, which feeds off the roller at 13*c*, around an arcuate member 30, between the latter and an anvil 31, and along the top of the rail or support in a leftward direction, in FIG. 1. A torsion spring 32 shown in FIG. 12 biases the member around a pivot 33, so as to forcibly urge the band portion 13*d* against the anvil, tending to "reverse bend" or straighten it to travel on a straight path leftwardly along the top of the rail. When initially training the band between member 30 and anvil 31, a handle 34 on member 30 may be grasped to pivot it upwardly away from the anvil, as required. Pivot 33 is attached to frame 21, and the anvil is attached to the frame at 35. The structure described may be considered as one form of means to extend or train the band in the lengthwise feed direction on support 25, and the member 30 and anvil 31 may be considered as one form of means to controllably and progressively reverse bend the band for straightening same to feed as described.

Guide means is also provided to guide the neck 11 or "wall", into position lying across section 13*a* of the extended band 13 on support 25. For this purpose, the guide means may be provided by a lateral slot 40 through a carrier or carriage 41, the slot shown as elongated in a forward and downward direction, and ultimately communicating with a lateral aperature 42 through the carrier. The carrier is movable relatively along the support or rail 25, and for this purpose may advantageously incorporate a lengthwise elongated slide 43 located between and attached to like carrier plates 44 which are laterally spaced apart, and extend in parallel relation. The undersurface of the slide glides along the top surface of the rail, and side flanges 43*a* extend downwardly and in close sliding relation with opposite sides of the support 25, for guidance purposes. Note that the slide is interrupted at zone 45 and in registration with slot 40, to provide continuous path for guidance of the bag neck or "wall" downwardly into the aperature 42, at times to be described.

Figure 2:
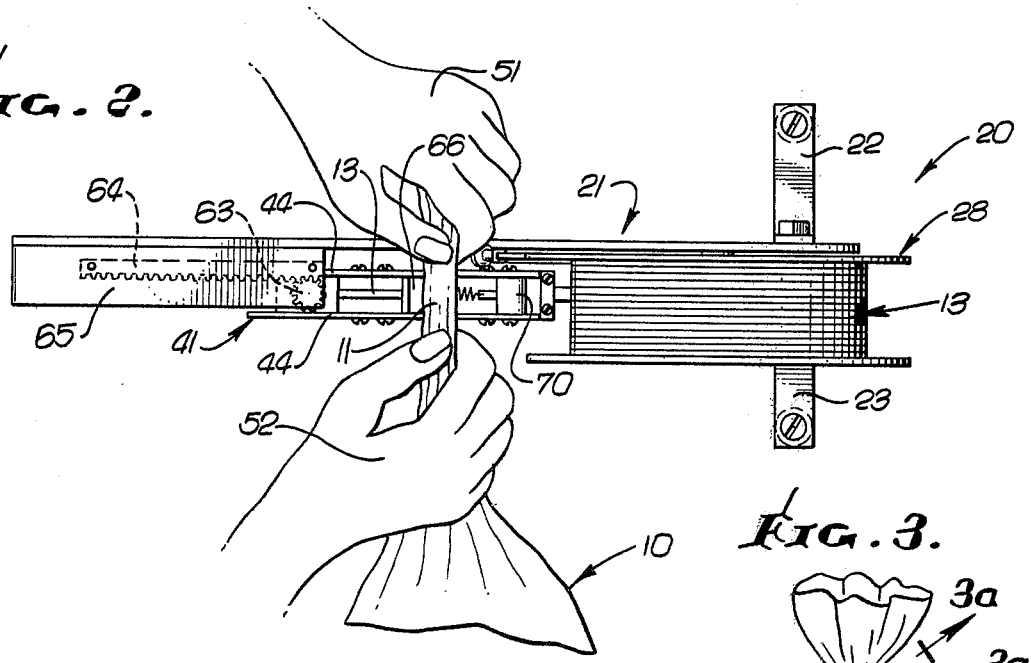
FIG. 2 is a top plan view showing a bag neck initially presented to the apparatus, for tying.

Means is also provided for folding the band section 13*a* over the bag neck to provide the two section arms 14 described above, and which are shown as upwardly folded toward one another in FIG. 5. The fold effecting means may with unusual advantage be defined by interior surfaces 45*a* and 45*b* of the slide or pad 43 which are located at lengthwise opposite sides of the first zone 45, across which section 13*a* extends. Note that as the bag neck is pressed down on the band section 13*a* in the position as viewed in FIG. 4, the band section is folded by surfaces 45*a* and 45*b* into the position seen in FIG. 5. A second zone 46 is located directly and openly below zone 45, and a movable catch in the form of plunger element 47 projects into that second zone as appears in FIG. 4. In that position, the plunger element blocks travel of the slide in the direction of arrows 27, since the plunger has a base 47*a* carried in a bore 48 in fixed support 25. A compression spring 49 urges the plunger upwardly, in FIG. 4. When the bag neck is displaced downwardly into zones 45 and 46, it causes the U-shaped bend of the band section to depress the plunger to a release position seen in FIG. 5, whereupon the carrier and slide may move lengthwise. FIG. 2 shows that the bag may be manually grasped by two hands 51 and 52 at opposite sides of the carrier, to pull the bag neck along the slot 40, and depress the bag neck into zones 45 and 46, to release the catch, allowing subsequent lengthwise travel of the carriage by leftward pull force exertion on the bag.

A tension spring 79 is attached to the carriage and also to the frame at 50 to urge the carriage rightwardly toward FIGS. 1, 4 and 5 positions. Carriage 41 including slide 43 may be considered as one form of means for effecting relative travel of the bag neck 11 or "wall", and the folded arms 14, in a leftward travel direction. Spring 49 serves as an extensible support for the tape, and prevents buckling thereof.

Means is also provided for twisting the folded arms during such relative travel, to produce the tie 12 about the wall or neck, as seen in FIGS. 3 and 6. Such means may with unusual advantage include a rotary twisting grip 55 on the carriage and engageable with the arms 14 to twist them, in response to rotation of the grip occurring in conjunction with relative travel of the carriage to the left, i.e. from FIG. 5 position to FIG. 6 position. Extending the description to FIGS. 9–11, the grip may include two grippers 60 with outer portions 60*a* curved in clockwise directions to receive the upstanding arms 14 as the grip rotates, and to rotate and twist the arms together. The grippers are suspended by a vertical shaft 61 bearing supported at 62 for rotation on the carriage. A gear 63 is attached to the upper end of the shaft to mesh with a rack 64 carried on the base or frame part 65, the latter suspended by frame plates 44. The rack extends in the direction of arrows 27, so that as the carriage is displaced lengthwise, the grippers 60 are rotated to twist the arms 14.

As the carriage travels leftwardly toward FIG. 6 position, the support 25 blocks downward displacement of the bag neck or wall into aperture 42; however, as shown in FIG. 6, upon completion of said leftward travel, the carriage arrives at bag discharge position, at which the tie has been completed. The bag neck may then be bodily displaced downwardly past the end of support 25 and into the aperture 42, following which the bag may be laterally displaced relative to and through the opening 42 to free the bag or article from the tie producing apparatus. Note in FIG. 6 that the left end portion of the carriage overhangs the end of the support 25, to free the bag neck to drop downwardly.

Means is also provided to sever the section 13*a* from main extent of the band, in response to guided displacement of the bag neck (or article wall) toward its initial position overlying the band section 13*a*. Such severing means may advantageously include an arm 66 pivotally supported by the carrier, as at 67, and a cutter 68 carried by the arm. The arm projects into the path (i.e. slot 40) of guided displacement of the neck or wall, as seen in FIG. 4, to be pivoted counterclockwise for effecting band severing. Note that cutter 68 is downwardly displaced to penetrate the band 13 in FIG. 4, as the arm pivots as described. In addition, a part 70 is provided to be operatively connected to the arm 66, as via tension spring 71. Clutch part 70 is also pivotally connected to the carriage, as at 72 to pivot into engagement with main extent of the band. Once it has engaged the band it remains in clutching engagement with the band so as to transport it to the left with the carriage as the carriage moves to FIG. 6 position, thereby accomplishing feed of the band to position another "band section" for subsequent severing on another cycle, after the carriage has been returned to FIGS. 1, 4 and 5 position. Part 70 has a clutching edge at 73. Spring 79, previously described is generally tubular, and protectively receives the straightened band 13 being fed toward the carriage.

Also shown is an elongated lever 75 pivoted to the frame at 76, to swing in a vertical plane. That lever engages the band windings on the drum or roll 28 to prevent inadvertent rotation of the drum. A tension spring 77 connected to the lever and the frame biases the lever into engagement with the band windings on the drum.

The basic method steps of the invention include the following:

(a) extending the band in a lengthwise feed direction,
(b) displacing said wall into position across a section of the extended band,
(c) effecting folded of said section of the band partially around said wall to provide two section arms relatively folded toward one another,
(d) relatively traveling said wall and folded arms in a travel direction, and
(e) twisting said arms during said relative travel to produce a tie about said wall.

As is clear from what has been described, the multiple steps of the method may be very simply accomplished merely in response to manually feeding the bag neck through slot 40, into zones 45 and 46, then pulling the bag neck to the left, and finally discharging the bag via aperture 42.

I claim:

1. In apparatus for securing a section of a tie band about a localized wall of an article, the band being foldable, the combination comprising (a) means for extending the band in a lengthwise feed direction,
(b) guide means for guiding the wall into position across a section of the extended band,
(c) means for effecting folding of said section of the band partially around the wall to provide two section arms relatively folded toward one another,
(d) means including a carrier to effect relative travel of the wall and folded arms in a travel direction, and
(e) means for twisting said folded arms during said relative travel to produce a tie about said wall,
(f) said fold effecting means defining a first zone located on the carrier in a direction of axial alignment with said twisting means to receive the wall after it has arrived at said position across said section of the extended band,
(g) said carrier including an elongated slide on which said fold effecting means is located, said slide having a top surface along which the unfolded band section initially extends, said top surface extending generally horizontally to define a plane below which said zone extends and above which said twisting means extends,
(h) the fold effecting means including surfaces at the sides of said zone to deflect the band section displaced into said zone by said wall so that said arms are simultaneously folded into positions adjacent said twisting means, said zone remaining in said direction of axial alignment with said twisting means and said surfaces extending in said direction.

2. The combination of claim 1 wherein said carrier is relatively movable in a lengthwise direction with the wall and folded arms movable with the carrier, and said means for twisting the said folded arms includes a rotary twisting grip engageable with said arms to twist same in response to rotation of said grip occurring during said relative travel of the carrier.

3. The combination of claim 2 including a support along which the carrier is lengthwise reciprocable between a wall receiving position and a wall discharge position, the carrier provided with an aperture through which at least a portion of said wall may pass laterally to become free of the carrier when the carrier is at said discharge position, the twisting grip being rotatable as the carrier moves between said wall receiving position and said wall discharge position.

4. The combination of claim 3 including a base, a rack on the base, and a gear located on the carrier to mesh with the rack, the gear operatively connected with the twisting grip to rotate same in response to said travel of the carrier.

5. The combination of claim 3 wherein said guide means is provided by a slot in the carrier communicating with said aperture.

6. The combination of claim 3 wherein said zone is in series with said aperture and intersects said plane, said support blocking access from said zone to said aperture until the carrier arrives at said discharge position.

7. The combination of claim 2 including means for severing said section from main extent of the band in response to guided displacement of the wall toward said position across said section of the extended band.

8. The combination of claim 7 wherein said means for severing said section includes an arm pivotally supported by the carrier and a cutter carried by the arm, the arm projecting into the path of said wall guided displacement to be pivoted in response to said wall guided displacement for effecting said severing by the cutter.

9. The combination of claim 1 including means for feeding main extent of the band in conjunction with said relative travel, to position another band section for subsequent severing.

10. The combination of claim 8 including a part operatively connected with the said arm, and supported by the carrier to pivot into engagement with main extent of the band to feed same in response to said travel of the carrier, to position another band section for subsequent severing.

11. The combination of claim 1 including said wall in said position, said wall defined by a gathered neck of a flexible article.

12. The combination of claim 11 wherein said article comprises a bag.

13. The combination of claim 3 including a movable catch element on the support projecting into a second zone into which the wall is displaced during said folding of the band section arms, said element blocking said travel of the carrier relative to the support until said element is moved by said displacement of the wall and folded band, to unblock said travel.

14. The combination of claim 1 wherein said means for extending the band includes means to guide main extent of the band off a supply roll and to controllably and progressively reverse bend the band for feeding in a straight path in said lengthwise direction.

15. The combination of claim 14 including a base and including said supply roll supported on the base, for rotation, said (b), (c), (d) and (e) means of claim 1 carried by the base.

* * * * *